US006607449B2

(12) United States Patent
McCabe

(10) Patent No.: US 6,607,449 B2
(45) Date of Patent: Aug. 19, 2003

(54) PUTTING DISC

(75) Inventor: Terrill R. McCabe, Carlsbad, CA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 09/849,977

(22) Filed: May 8, 2001

(65) Prior Publication Data

US 2002/0169028 A1 Nov. 14, 2002

(51) Int. Cl.[7] ..... A63B 69/36
(52) U.S. Cl. ..... 473/180
(58) Field of Search ..... 473/180, 181, 473/185, 196, 174

(56) References Cited

U.S. PATENT DOCUMENTS 884,277 A * 4/1908 Hughes ..... 273/127 B
1,105,274 A * 7/1914 Hughes ..... 473/180
1,656,740 A * 1/1928 Kurtz ..... 273/127 B
2,121,270 A * 6/1938 Streich ..... 473/185
4,861,033 A * 8/1989 Miner ..... 473/180
4,906,006 A * 3/1990 Sigunick ..... 473/179
5,435,560 A * 7/1995 Kehoe ..... 473/174
5,997,406 A * 12/1999 Selton ..... 473/180
6,241,621 B1 * 6/2001 Maher ..... 473/162
6,283,873 B1 * 9/2001 Nunes ..... 473/174

* cited by examiner

*Primary Examiner*—Mark S. Graham
(74) *Attorney, Agent, or Firm*—Swidler Berlin Shereff Friedman, LLP

(57) ABSTRACT

A target for practicing golf strokes is provided, the target formed of a substantially circular member. The member includes a ramp portion with an outer edge and an inner edge, and a substantially flat central portion disposed within the inner edge of the ramp portion. The member also includes a plurality of stake holes, at least one elongate hole, and a plurality of alignment indicia. At least one of the alignment indicia is disposed about a diameter of the member. A flat edge may extend along a portion of the outer edge.

16 Claims, 5 Drawing Sheets

PUTTING DISC

FIELD OF THE INVENTION

The present invention generally relates to devices for practicing golf putting strokes. More particularly, the invention concerns a novel putting practice device in the form of a putting disc that serves as an alignment tool during putting as well as a movable target for practicing the targeting and execution of such strokes in various locations on a surface.

BACKGROUND OF THE INVENTION

Putting accuracy is a critical measure of a player's success in golf. While golf ball driving accuracy is an important factor in moving the ball over the several hundred yards that may have to be traversed to reach a green, the number of strokes required on the green to sink the golf ball in the cup, and thereby complete the hole, each count equally in stroke scoring. Accordingly, golfers spend a significant amount of time practicing their putting technique. One practice method involves putting on a practice green that is fashioned with suitable grass and holes marked with flags. Typically, a practice green has varying contours across its surface and several holes, thus permitting a golfer to drop practice balls at different locations within or near the green's perimeter and practice strokes as a function of distance to the cup, degree of green incline, and contour of the green incline.

Despite the availability of putting greens, these areas are often set up with semi-permanent cup locations (the cups have been set into the ground below surface level) and thus a player is prevented from selecting exact target locations for practice. In addition, the practice areas do not permit the golfer to perfectly simulate a put on a course's green, as the practice areas are typically not equivalent in dimension or conditions to the actual greens of a given course. In addition, practice greens can become crowded, and thus the inherent space constraints of such areas may not permit sufficient practice or the completion of a satisfactory practice session.

It is known that movable cups may be used to practice putting. Many such devices have been developed, but the design of these devices often interferes with the normal progression of the golf ball during a stroke. For instance, the geometry of the movable cup may prevent the realistic simulation of golf ball behavior when the ball reaches the vicinity of the cup. Such devices may not mimic the behavior of a cup that has been recessed into the ground, and thus a putted ball may not fall into the cup as expected, or scatter away from it as expected due to improper ball speed or aim. Thus, such devices may render a golfer's practice stroke too easy or too difficult, and thus may not serve as a productive tool for improving a player's performance.

One known portable golf putting cup is disclosed in U.S. Pat. No. 5,487,545 to Schindler. The cup has a circular base and an upwardly curved outer wall which builds resistance as the golf ball climbs the wall before dropping into a circular depression. The cup also includes an angled-shock-absorbing lip, golf-ball-gripping teeth, reclining inner walls, and shock-absorbing material.

Another golf ball receiver is disclosed in U.S. Pat. No. 5,997,406 to Selton. The golf ball receiver includes an annular wall and a cavity for receiving a golf ball. A force absorbing member is disposed within the cavity for absorbing the force of the golf ball when the golf ball enters the cavity. U.S. Pat. No. 1,287,903 to Daily also discloses a putting disk in the form of a truncated cone-like member with a circular periphery and a central depression or opening that acts as the receptacle for a ball. The annular surface between the periphery of the disk and the central receptacle is concave and parabolic. A spike may be provided for anchoring the putting disk to the ground.

In addition, U.S. Pat. No. 5,779,567 to Durso discloses a training method for golfers. A portably-sized, substantially flat web material having a dark color so as to be easily discernable is provided with an internal target such as a circular hole that has a diameter approximate or equal to the diameter of a standard golf course putting green hole. The flat web material has a transverse dimension of about one-half foot to about three feet.

U.S. Pat. No. 5,435,560 to Kehoe also discloses a golf putting and chipping target. The target includes a thin, flexible circular disk with a centrally located, solid, dark colored circle surrounded by a contrasting, light colored border. The dark colored circle simulates a conventional golf hole. The target further includes a 17 inch long strip of adhering material for measuring this known distance from the disk to determine whether a put at optimum speed would stop within that distance behind the disk.

Despite these developments, there remains a need for a practice putting target that is convenient to carry, anchor, and use at a variety of locations. In addition, there exists a need for a practice putting device that can be used to closely simulate a regulation putting cup so that golf ball movement in the vicinity of the device is similar to golf ball movement in the vicinity of a regulation cup. There further exists a need for a practice putting device in the form of a putting disc that includes alignment indicia, multiple anchor points, and a slot for accommodating a band for attachment of the disc to another object such as a golf bag.

SUMMARY OF THE INVENTION

The invention relates to a target for practicing golf strokes, the target including a substantially circular member with a top surface and a bottom surface. The member includes a ramp portion with an outer edge and an inner edge, and a substantially flat central portion disposed within the inner edge of the ramp portion. The member further includes a plurality of stake holes, at least one elongate hole, and a plurality of alignment indicia. At least one of the alignment indicia is disposed about a diameter of the circular member.

In one embodiment, at least two stake holes are disposed about a common axis, and the stake holes are configured and dimensioned to receive golf tees. The alignment indicia may be disposed on the top surface or bottom surface of the member. At least one elongate hole is configured and dimensioned to receive a luggage band.

The ramp portion is disposed at an angle of between about 5° and about 60° with respect to the plane of the bottom surface. In some embodiments, the ramp portion is disposed at an angle of between about 20° and about 40° with respect to the plane of the bottom surface, and the ramp portion may be disposed at an angle of about 30° with respect to the plane of the bottom surface. The circular member has a diameter of between about 3.6 inches and about 4.6 inches. In some embodiments, the circular member has a diameter of about 4.25 inches. The central region of the member may be vertically separated by about 0.04 inch to about 0.08 inch from the inner edge, and in some embodiments the central region is vertically separated by about 0.06 inch from the inner edge.

The target also may include a flat edge extending along a portion of the outer edge. A flat face may extend from the flat edge, with the flat face being disposed generally perpendicular to the top surface. When the diameter of the circular member intersects the outer edge at two points, the length of the flat edge is between about 20% and about 30% of the length of the diameter, and may be about 25% of the length of the diameter. The flat edge additionally may be disposed generally perpendicular to at least one alignment indicia.

BRIEF DESCRIPTION OF THE DRAWINGS

Preferred features of the present invention are disclosed in the accompanying drawings, wherein similar reference characters denote similar elements throughout the several views, and wherein.

DETAILED DESCRIPTION OF THE PREFERRED.EMBODIMENT

Figure 1:
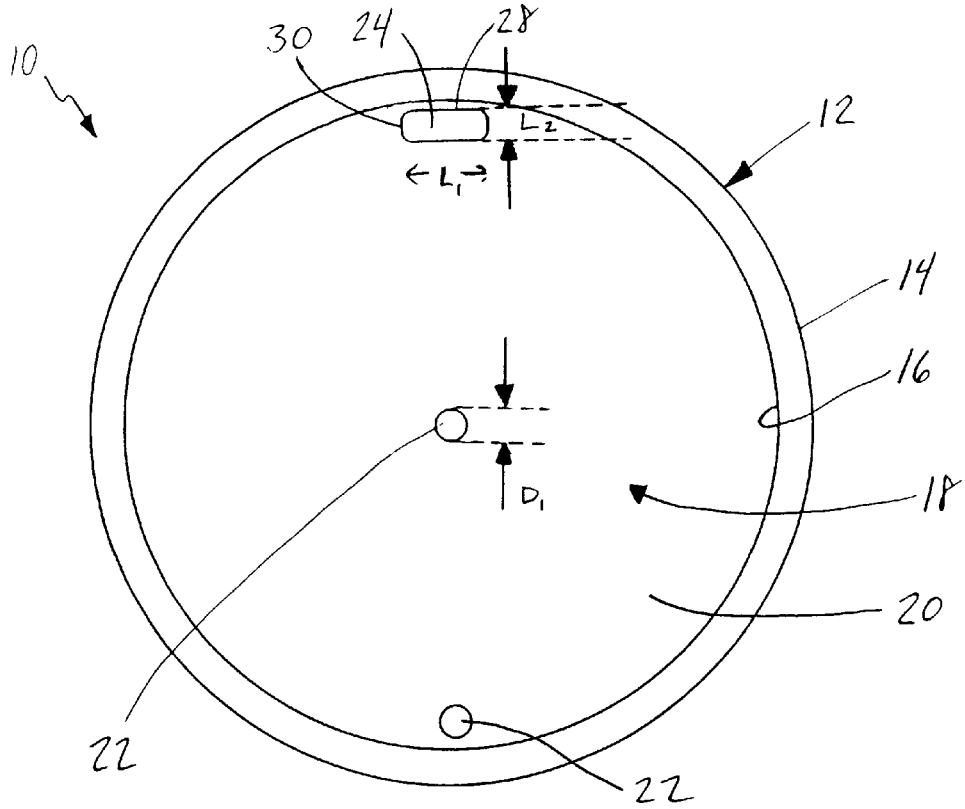
FIG. 1 is a top plan view of a first embodiment of a putting disc according to the present invention.

Referring to FIGS. 1–4, a first embodiment of a putting disc according to the present development is shown. Putting disc 10 has a ramp 12 with a generally circular outer periphery 14 and a generally circular inner edge 16. A flat, central region 18 on top surface 20 is bounded by inner edge 16. Through-holes 22 and an elongate hole 24 each extend from top surface 20 to bottom surface 26 of putting disc 10. Preferably, through-holes 22 are circular with a diameter $D_1$. In the preferred embodiment, diameter $D_1$ is between about 0.1 inch and 0.3 inch, and more preferably about 0.2 inch. Such a size may accommodate a typical golf tee. Through-holes 22 are preferably disposed such that at least two holes are generally coaxial, such as along axis ALI. By placing tees in coaxial through-holes 22, putting disc 10 may be staked to the ground in a balanced fashion such that it rests evenly on a surface.

Longer sides 28 of elongate hole 24 have a length $L_1$, while shorter sides 30 have a length $L_2$, with $L_1$ being greater than $L_2$. Preferably, a longer side 28 is oriented adjacent inner edge 16. In the preferred embodiment, length $L_1$, is between about 0.4 inch and about 0.6 inch, and more preferably 0.5 inch, while length $L_2$, is between about 0.1 inch and about 0.3 inch, and more preferably 0.2 inch. The sizing of elongate hole 24 accommodates a typical band, such as a luggage tag band, for use in attaching putting disc 10 to a golf bag. The inner corners of elongate hole 24 may be rounded. Through-holes 22 and elongate hole 24 are preferably located near inner edge 16 and/or the center of central region 18.

Figure 2:
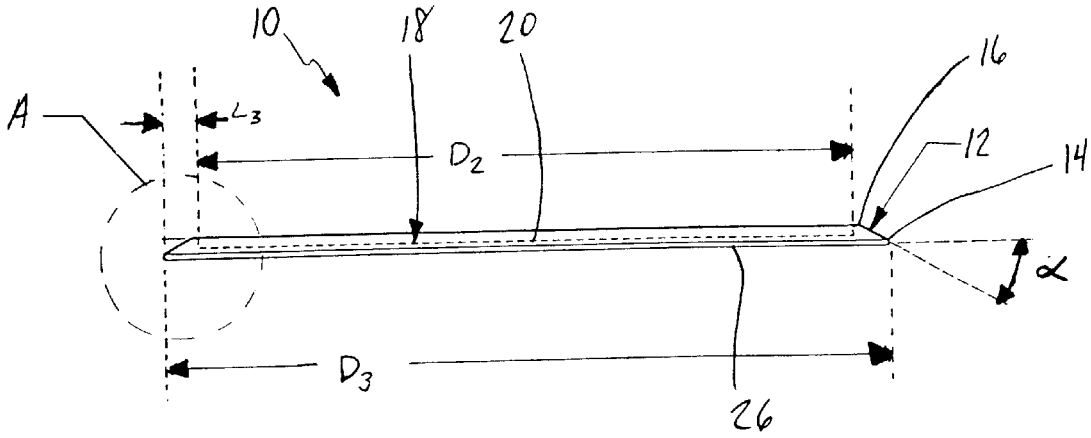
FIG. 2 is a side, partial cross-sectional view of the putting disc of FIG. 1.
Figure 3:
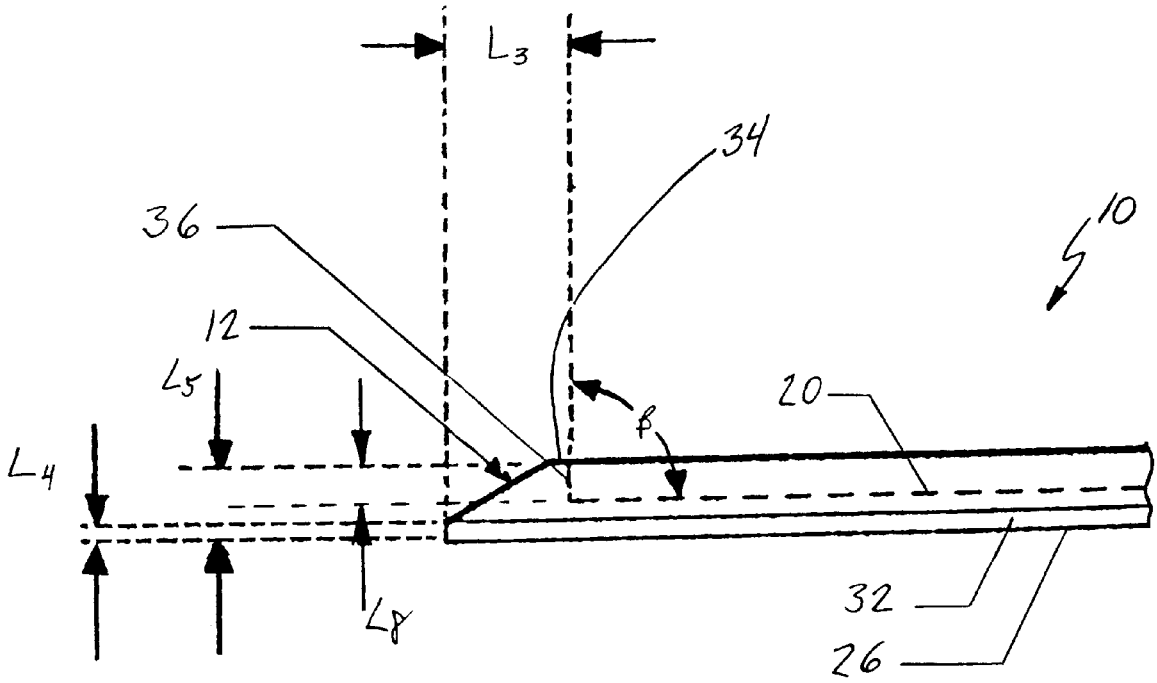
FIG. 3 is a partial side, partial cross-sectional view at region A of the putting disc of FIG. 1 showing angular and dimensional geometry.

As shown in FIGS. 2 and 3, flat, central region 18 is recessed uniformly relative to inner edge 16, and has an overall diameter $D_2$. Preferably, diameter $D_2$ is between about 3.5 inches and about 4.5 inches, and more preferably about 3.85 inches. Outer periphery 14 has a diameter $D_3$, which preferably is between about 3.6 inches and about 4.6 inches, and more preferably about 4.25 inches. Ramp 12 is preferably straight and disposed at an angle $\alpha$ with respect to the plane that includes bottom surface 26 of putting disc 10. Preferably, angle a is between about 5° and about 60°, more preferably between about 20° and about 40°, and most preferably angle a is about 30°. Furthermore, ramp 12 has an overall length $L_3$ as measured in the direction parallel to bottom surface 26. Length $L_3$ preferably is between about 0.1 inch and about 0.3 inch, and more preferably about 0.2 inch.

Referring to FIG. 3, putting disc 10 includes a base portion 32 which is disposed perpendicular to outer periphery 14 of ramp 12. Base portion 32 has a thickness $L_4$, which preferably is between about 0.02 inch and about 0.04 inch, and more preferably about 0.03 inch. The overall height $L_5$ of putting disc 10 is preferably between about 0.10 inch and about 0.15 inch, and more preferably is about 0.125 inch. The depth $L_8$ of central region 18 with respect to inner edge 16 is preferably between about 0.04 inch and about 0.08 inch, and more preferably about 0.06 inch. In addition, a short, flat surface 34 optionally may be provided between ramp 12 and the region of top surface 20. Flat surface 34 is generally parallel to top surface 20, and preferably is between about 0 inch and 0.06 inch in length. Internal face 36 is disposed at an angle $\beta$ with respect to top surface 20, with angle $\beta$ preferably being about 90°.

Figure 4:
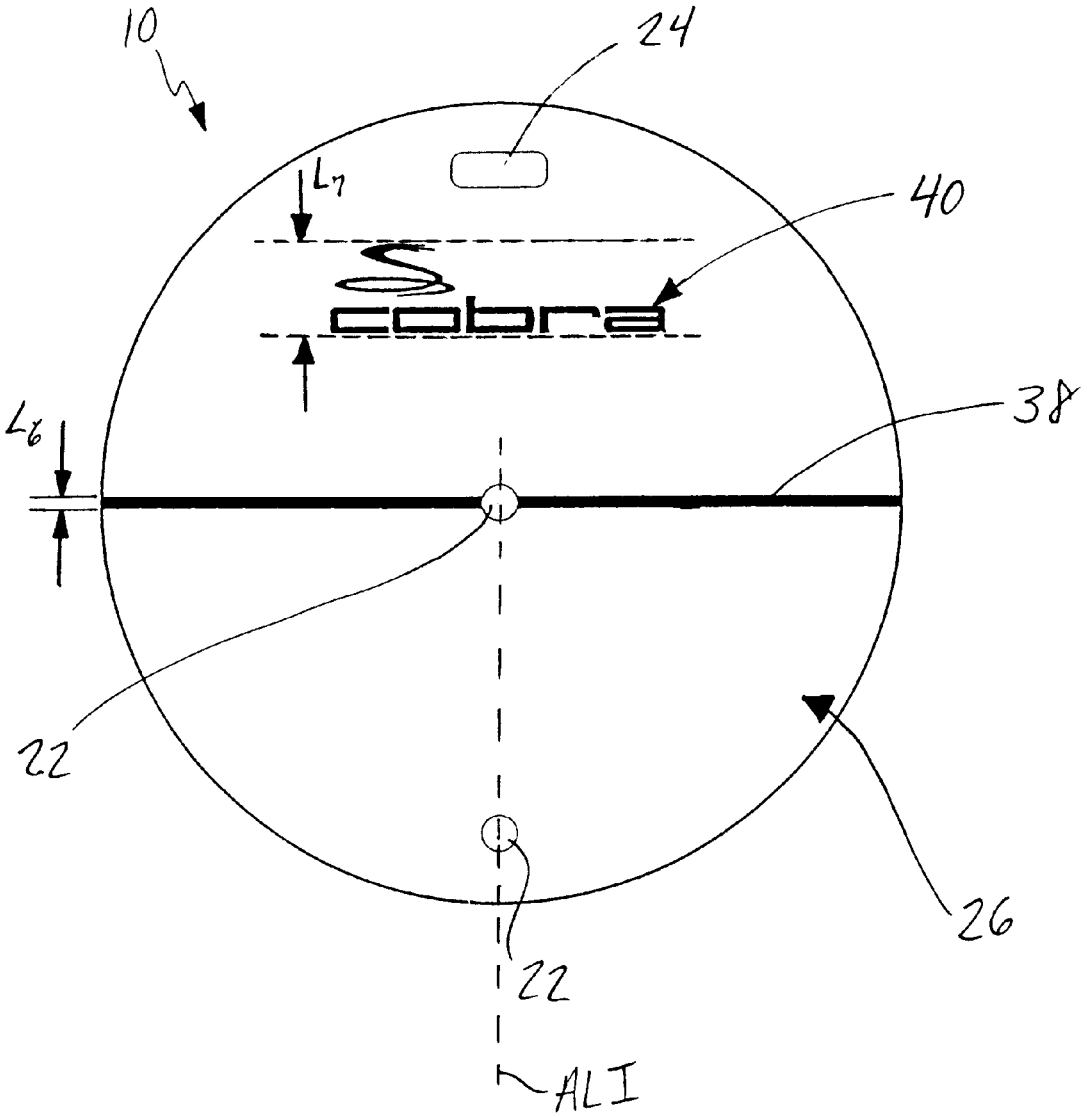
FIG. 4 is a bottom plan view of the putting disc of FIG. 1.

Turning to FIG. 4, bottom surface 26 of putting disc 10 is shown. In the preferred embodiment, at least two alignment indicia 38, 40 are provided on bottom surface 26. Preferably, a straight line 38 is provided, marking a diameter of putting disc 10 and thus extending through hole 22 at the center of putting disc 10. Indicia 38 preferably has a thickness $L_6$ that is less than or equal to the diameter of hole 22. Alignment indicia 40 is preferably oriented generally parallel to indicia 38, and for example, may be in the form of a logo, lettering, and/or other geometric shapes including another straight line. Preferably, indicia 40 has a width $L_7$ that is greater than thickness $L_6$ of indicia 38. In addition, indicia 38, 40 are spaced apart from each other so that there is no overlap between them. In alternate embodiments, only one alignment indicia is provided.

A string or other alignment member (not shown) may be attached to putting disc 10, such as at holes 22, 24, and alignment indicia 38, 40 may be used for orienting the string or device. When attached to putting disc 10, the string also may be used for putting alignment independent of alignment indicia 38, 40.

Figure 5:
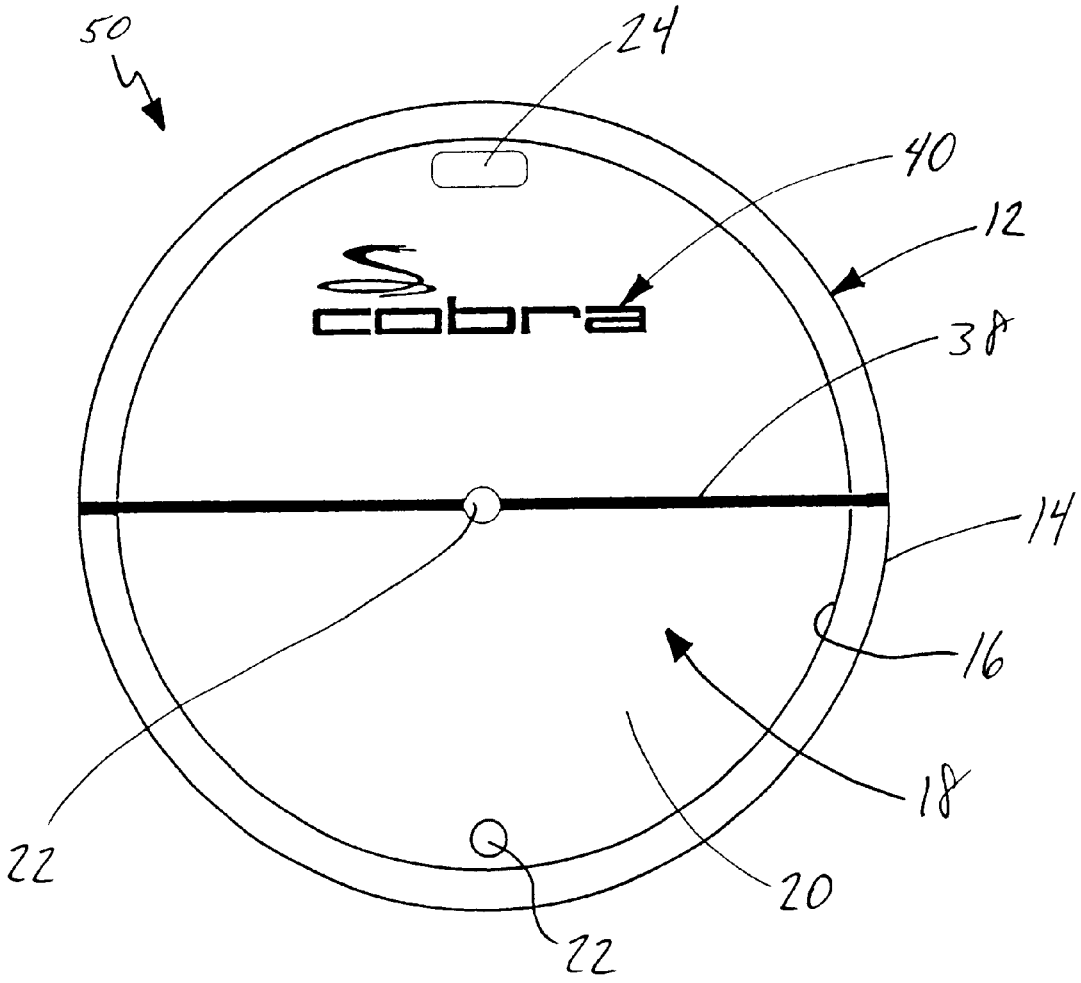
FIG. 5 is a top plan view of a second embodiment of a putting disc according to the present invention.

In a variant of the first embodiment, a putting disc 50 is shown in FIG. 5. In this second embodiment of the present invention, alignment indicia 38, 40 are disposed on top surface 20. Indicia 38 may extend across ramp 12, or alternatively indicia 38 may only extend to inner edge 16. The provision of such indicia on top surface 20 permits a golfer to visually align a shot with reference to the indicia.

Figure 6:
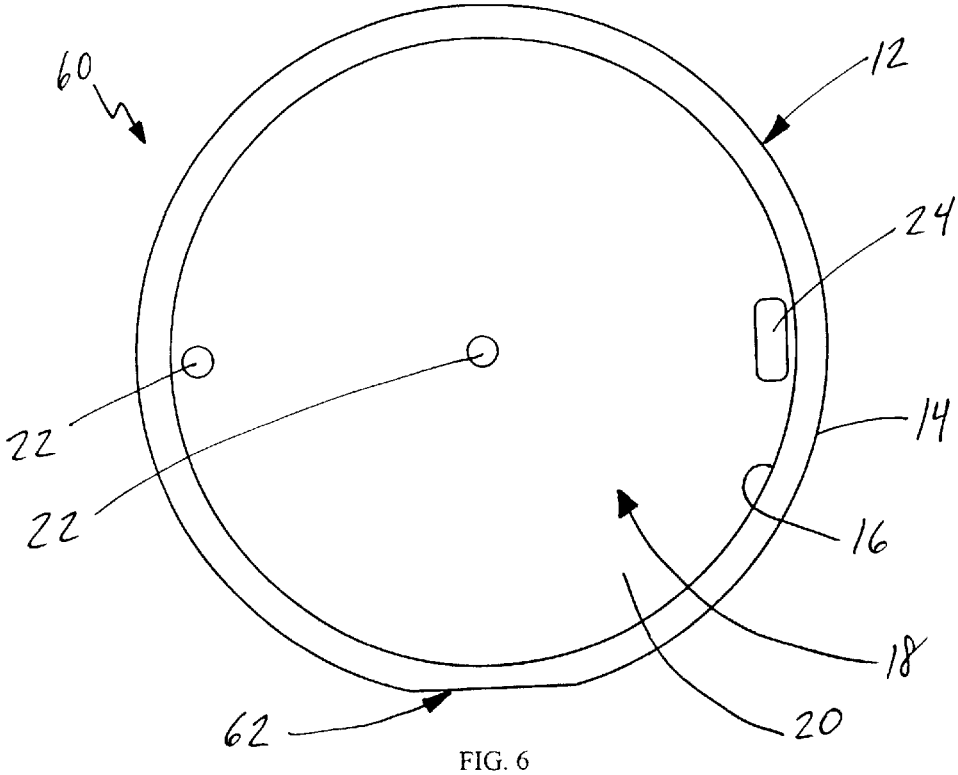
FIG. 6 is a top plan view of a third embodiment of a putting disc according to the present invention.
Figure 7:
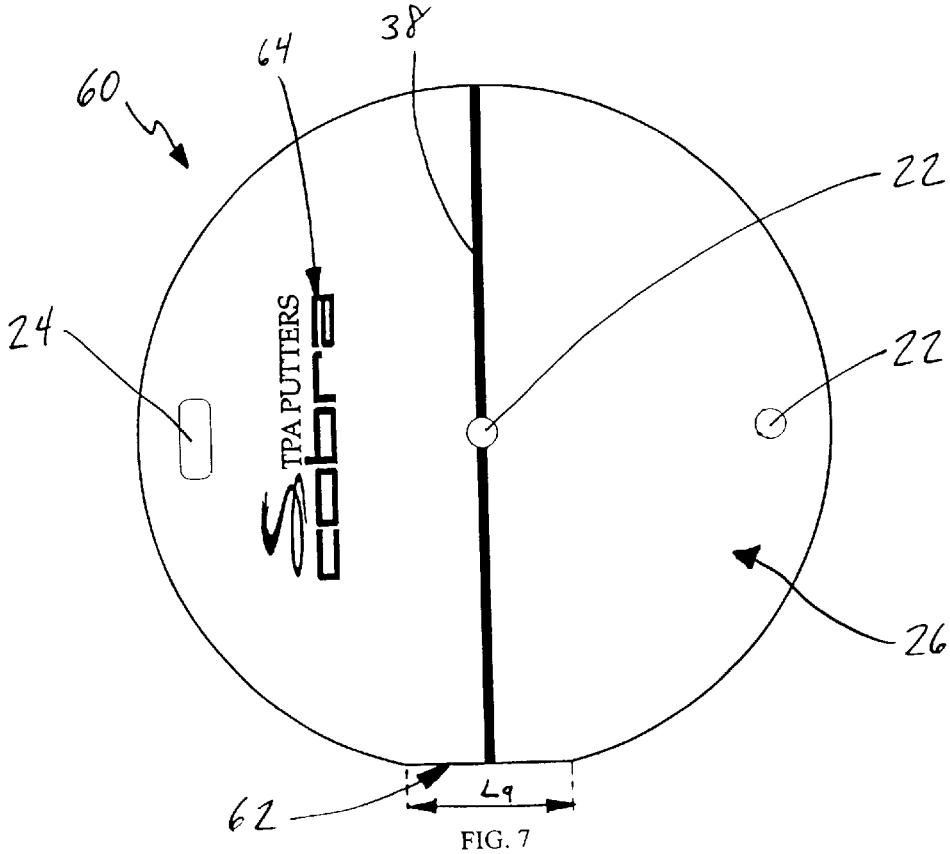
FIG. 7 is a bottom plan view of the putting disc of FIG. 6.

Referring to FIGS. 6–7, a third embodiment of the present invention is shown. Putting disc 60 includes a flat edge 62 along and interrupting outer periphery 14. Flat edge 62 defines a face that is generally perpendicular to top surface 20, and may be used by a golfer to square the putter with respect to putting disc 60. In particular, a putter may be placed against flat edge 62 during practice shot alignment. Preferably, flat edge 62 is generally perpendicular to alignment indicia 38, so that a T-shaped alignment region is formed. In addition, flat edge 62 preferably has an overall length $L_9$ between about 20% and about 30% of diameter $D_3$ of outer periphery 14, and more preferably about 25% thereof. Additional alignment indicia 64 may be provided, similarly to indicia 40 as previously described. In addition, as already discussed, although indicia 38, 64 are shown on bottom surface 26 of putting disc 60, the indicia 38, 64 may alternatively be placed on top surface 20.

While various descriptions of the present invention are described above, it should be understood that the various features can be used singly or in any combination thereof. Therefore, this invention is not to be limited to only the specifically preferred embodiments depicted herein.

Further, it should be understood that variations and modifications within the spirit and scope of the invention may occur to those skilled in the art to which the invention pertains. For example, in an alternate embodiment, the putting disc may be provided with a protruding outer rim on its bottom surface for depressing into the ground. In addition, alignment indicia may be provided on both the top surface and bottom surface of the putting disc. Accordingly, all expedient modifications readily attainable by one versed in the art from the disclosure set forth herein that are within the scope and spirit of the present invention are to be included as further embodiments of the present invention. The scope of the present invention is accordingly defined as set forth in the appended claims.

What is claimed is:

1. A target for practicing golf strokes, the target comprising a substantially circular member with a top surface and a bottom surface, the member comprising:

a ramp portion with an outer edge and an inner edge;

a flat edge extending along a portion of the outer edge;

a substantially flat central portion disposed within the inner edge of the ramp portion;

a plurality of stake holes;

at least one elongate hole; and a plurality of alignment indicia, wherein at least one of the alignment indicia is disposed about a diameter of the circular member, wherein a flat face extends from the flat edge, the flat face being disposed generally perpendicular to the top surface, and wherein the diameter intersects the outer edge at two points, and the length of the flat edge is between about 20% and about 30% of the length of the diameter.

2. The target of claim 1, wherein the length of the flat edge is about 25% of the length of the diameter.

3. The target of claim 1, wherein the flat edge is disposed generally perpendicular to at least one alignment indicia.

4. The target of claim 1, wherein the ramp portion is disposed at an angle of between about 5° to and about 60° with respect to the plane of the bottom surface.

5. The target of claim 1, wherein the central portion of the member is vertically separated by about 0.04 inch to about 0.08 inch from the inner edge.

6. The target of claim 1, wherein at least two stake holes are disposed about a common axis.

7. The target of claim 6, wherein the alignment indicia are disposed on the top surface of the member.

8. The target of claim 6, wherein the stake holes are configured and dimensioned to receive golf tees.

9. The target of claim 8, wherein the at least one elongate hole is configured and dimensioned to receive a luggage band.

10. The target of claim 1, wherein the ramp portion is disposed at an angle of between about 5° and about 40° with respect to the plane of the bottom surface.

11. The target of claim 1, wherein the ramp portion is disposed at an angle of between about 20° and about 40° with respect to the plane of the bottom surface.

12. The target of claim 1, wherein the ramp portion is disposed at an angle of about 30° with respect to the plane of the bottom surface.

13. The target of claim 1, wherein the circular member has a diameter of between about 3.6 inches and about 4.6 inches.

14. The target of claim 1, wherein the circular member has a diameter of about 4.25 inches.

15. The target of claim 1, wherein the central portion of the member is vertically separated by about 0.04 inch to about 0.08 inch from the inner edge.

16. The target of claim 1, wherein the central portion of the member is vertically separated by about 0.06 inch from the inner edge.

* * * * *